US006464894B1

(12) United States Patent
Antochin et al.

(10) Patent No.: US 6,464,894 B1
(45) Date of Patent: Oct. 15, 2002

(54) MAGNETIC FILM AND A METHOD FOR THE PRODUCTION THEREOF

(75) Inventors: Sergej Antochin, Vörstetten; Wilhelm Fernengel, Kleinostheim; Matthias Katter, Alzenau; Werner Rodewald, Grundau; Boris Wall, Langenselbold, all of (DE)

(73) Assignee: Vacuumschmelze GmbH, Hanau (DE)

( * ) Notice: Subject to any disclaimer, the term of this patent is extended or adjusted under 35 U.S.C. 154(b) by 0 days.

(21) Appl. No.: 09/601,910

(22) PCT Filed: Feb. 5, 1999

(86) PCT No.: PCT/EP99/00779

§ 371 (c)(1),
(2), (4) Date: Sep. 12, 2000

(87) PCT Pub. No.: WO99/40592

PCT Pub. Date: Aug. 12, 1999

(30) Foreign Application Priority Data

Feb. 9, 1998 (CH) ..... 313/98

(51) Int. Cl.[7] ..... H01F 1/00; H01F 41/02

(52) U.S. Cl. ..... 252/42.54; 252/62.55; 264/212; 264/216; 264/429; 264/427

(58) Field of Search ..... 252/62.54, 62.55; 264/429, 427, 212, 216

(56) References Cited

U.S. PATENT DOCUMENTS 3,070,841 A * 1/1963 Schornsteimer ..... 252/62.53
3,467,598 A * 9/1969 Kroenke ..... 252/62.54
3,764,539 A * 10/1973 Cochardt et al. ..... 252/62.53
4,200,457 A * 4/1980 Beck ..... 252/62.54
4,562,019 A * 12/1985 Inoue ..... 252/62.54
4,881,988 A * 11/1989 Bonser ..... 252/62.54
5,607,768 A * 3/1997 Lee ..... 252/62.54
5,888,417 A * 3/1999 Akioka et al. ..... 252/62.55

FOREIGN PATENT DOCUMENTS

| | | |
|---|---|---|
| DE | 2456121 | 7/1975 |
| DE | 4228520 | 3/1994 |
| EP | 0274034 | 7/1988 |
| EP | 274034 | * 7/1988 |
| JP | 1-313903 | * 12/1989 |

OTHER PUBLICATIONS

Derwent abstract for JP 1–313903, attached to JP 1–313903.*

Abstract of Japanese Patent Document No. 01313903 (Dec. 19, 1989).

* cited by examiner

*Primary Examiner*—C. Melissa Koslow
(74) *Attorney, Agent, or Firm*—Dean W. Russell; Kilpatrick Stockton LLP

(57) ABSTRACT

The invention relates to hard magnetic films made of a polymer matrix and hard magnetic powder particles distributed therein. The films have a thickness of preferably 100 to 500 μm and are flexible. They can be produced by using a casting method and are suited, for example, as hard magnetic components in miniature motors, polarized relays or sensors.

9 Claims, 5 Drawing Sheets

MAGNETIC FILM AND A METHOD FOR THE PRODUCTION THEREOF

FIELD OF THE INVENTION

The invention concerns a hard magnetic film with a polymer base particularly intended for use in electric motors or sensor applications and a method for the production thereof.

BACKGROUND OF THE INVENTION

Owing to the continued trend to miniaturization in the field of electronics there is an increasing demand for particularly small or flat electric motors. These motors, which conventionally contain hard magnetic components in the stator and/or rotor, naturally require particularly flat magnetic components. Similarly there is an increasing demand for particularly flat permanent magnets for miniature relays and sensors functioning on magnetic principles (such as rotation or position sensors). In addition these magnets should be as flexible as possible so that if desired they may be brought to the desired shape after magnetization and may avoid breakage during processing or in operation.

According to conventional methods utilized for the production of permanent magnets from powdered metallic or non-metallic magnetic materials, the cost-effective production of flat objects with a low thickness of for example 100 $\mu$m and high energy density is impossible.

SUMMARY OF THE INVENTION

The task of the present invention therefore was to make available a flexible hard magnetic material with low thickness and a cost-effective method for the production thereof.

It was found that the application of casting technology enables the production of carrier-free hard magnetic films from a polymer matrix and a hard magnetic powder distributed therein. The term "carrier-free" signifies that the finished films—unlike for example those films already known from magnetic tapes or floppy disks—are constructed not from a non-magnetic carrier and a single- or double-sided layer capable of magnetization, but from a single continuous layer that is magnetic or capable of magnetization. The hard magnetic powder has usefully a median particle size of less than 100 $\mu$m, preferably less than 20 $\mu$m.

Films according to the invention advantageously have a thickness of 50 to 2000 $\mu$m, preferably one of 100 to 500 $\mu$m.

The volume fraction of the hard magnetic powder in magnetic film according to the invention can be adjusted as desired. The preferred value is at least 50% but especially preferred is at least 60%. The polymer fraction can be kept so low that the polymer effectively occupies simply the voids in an approximately dense packing of the powder particles.

In films according to the invention the preferred content of hard magnetic powder consists of one or more rare earth alloy(s). Within the scope of the invention, however, other hard magnetic materials can be employed, for instance Al-Ni-Co or Cr-Fe-Co alloys or ferrites.

Particularly preferred are rare earth alloys described by the general formulas $RECo_5$, $(RE)_2(Co,Fe,Cu,Zr)_{17}$ or $(RE)_2Fe_{14}B$. Here RE signifies an element from the group consisting of yttrium, lanthanum, cerium, praseodymium, neodymium, samarium, europium, gadolinium, terbium, dysprosium, holmium, erbium, thulium, ytterbium and lutetium or a mixture of several of these elements. Most particularly preferred are the compounds $Sm_2(Co,Fe,Cu,Zr)_{17}$ and $(Pr,Nd,Dy)Fe_{14}B$. Alloys of these types are available for example under the brand names VACOMAX® and VACODYM® from the company Vacuumschmelze GmbH or the brand name MAGNEQUENCH® from the company Magnequench Inc. References herein to "(Co,Fe,Cu,Zr)" refer to the listed elements generally in the disjunctive (in other words, "one or more of Co or Fe or Cu or Zr"). Likewise, the preceding use of "(Pr,Nd,Dy")" refers to the listed elements in this manner.

The polymer matrix can basically consist of any polymer that is soluble or dispersible in volatile solvent. It is also possible to utilize polymers that are available in appropriate forms of thin layers of low-viscosity monomers or oligomers. In these instances the use of solvent during production can be omitted where desired. It is preferable to utilize soluble thermoplastic material, particularly soluble polyvinylidene fluoride. It is, however, also possible to utilize non-thermoplastic material such as single-component polyurethane dispersions.

The hard magnetic powder particles can be aligned in no particular order (isotropic) or, if they display inherent anisotropy, can be aligned as desired. They are preferably aligned parallel or vertical to the surface of the film.

The residual magnetism of magnetic films according to the invention is determined by the type and packing density of hard magnetic powder particles and has a preferred value of 0.2 to 0.8 tesla.

Magnetic films according to the invention can for example by produced by (i) dispersing a powder of hard magnetic material in a solution or dispersion of polymer material in a volatile solvent, (ii) casting the dispersion thus obtained as a film of defined thickness on a revolving casting belt, (iii) evaporating the solvent and (iv) withdrawing the film thus formed from the casting belt. The film can be magnetized after evaporation of the solvent or at a later time (for example after fabrication), such that the binding of the magnetic particles in the polymer matrix yields an isotropic magnetic film.

In a preferred form of the method according to the invention the orientation of the hard magnetic powder particles is created by means of an external magnetic field between the casting process and withdrawal of the film.

Particularly preferred is an orientation before hardening of the cast film. Particles of an anisotropic material can here by aligned in an external magnetic field so as to yield an anisotropic magnetic film.

Magnetization and alignment where desired can be carried out preferably by means of pulsed magnetic field. Here the use of electromagnetic can enable high field strengths with low energy consumption. Hard magnetic powder particles for which orientation is particularly easy can also be orientated in the air gap of an appropriate permanent magnet yoke.

A preferred material for the hard magnetic powder is a rare earth alloy.

Particularly preferred are rare earth alloys described by the general formulas $RECo_5$, $(RE)_2(Co,Fe,Cu,Zr)_{17}$ or $(RE)_2Fe_{14}B$ where RE signifies one or more of the elements Y, La, Ce, Pr, Nd, Sm, Eu, Gd, Tb, Dy, Ho, Er, Tm, Yb or Lu.

A preferred material for the polymer is soluble polyvinylidene fluoride (copolymer).

A preferred volatile solvent for soluble polyvinylidene fluoride (copolymer) is acetone.

The revolving casting belt consists preferably of dull special steel.

DETAILED DESCRIPTION

Figure 1:
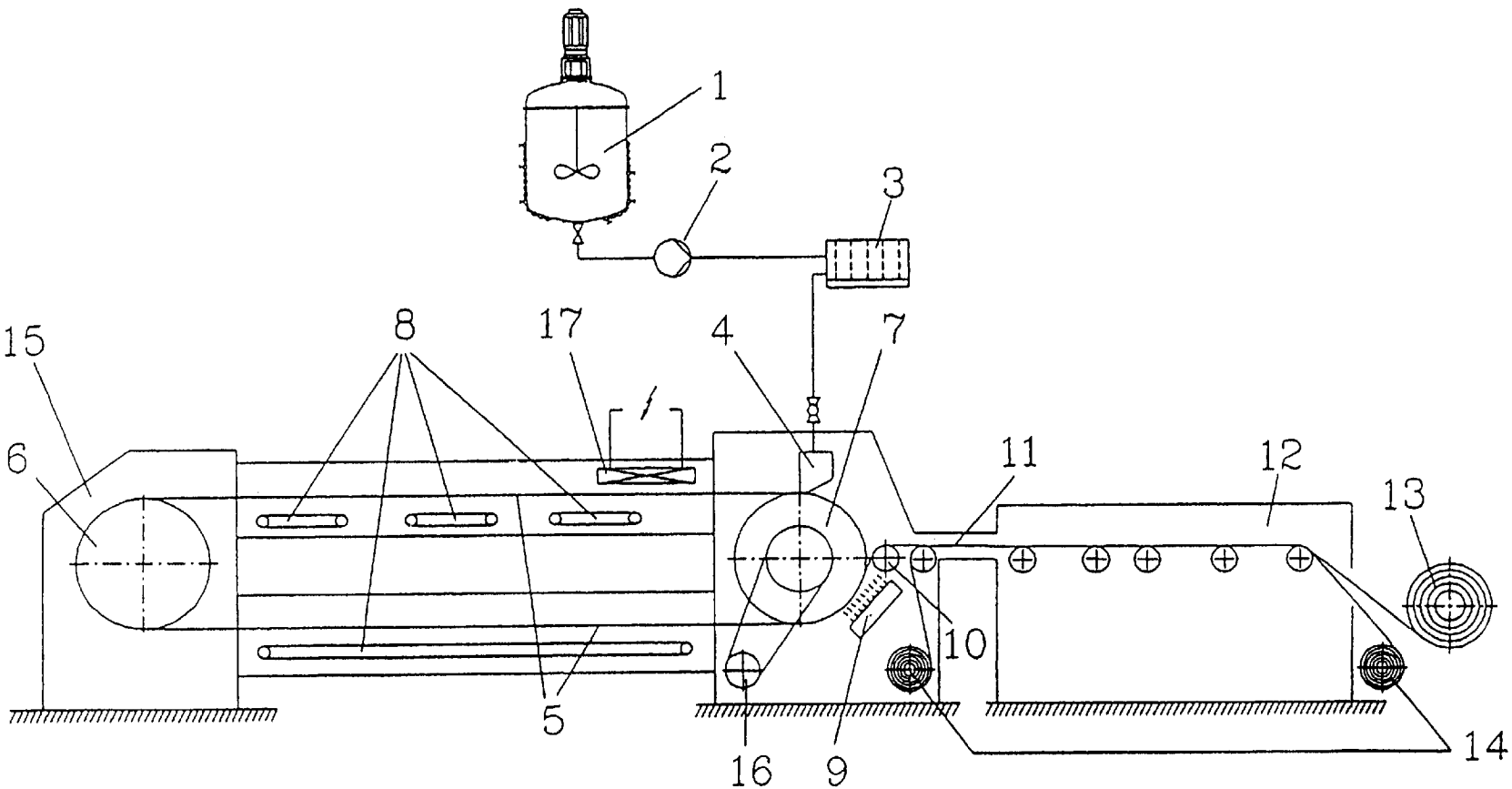
FIG. 1 is a schematic view of an apparatus for producing a magnetic film of the present invention.

An apparatus for production of magnetic film according to the invention is shown in FIG. 1. The actual casting assembly comprises a controlled-temperature supply container 1 with a stirrer for the casting solution or dispersion, a controllable feed pump 2, a filter 3 separating agglomerates and the casting apparatus 4. The casting solution or dispersion is cast onto an endless casting belt 5 which revolves around rollers 6,7 and is indirectly heated by heating elements 8. The casting belt is driven by one of the rollers which is fitted with a controlled-speed drive 16. A cooling system 9 cools the magnetic film 11 as desired prior to withdrawal from the casting belt by means of a withdrawal apparatus 10. In order to remove any residual solvent the magnetic film can be dried as desired in a drying station 12 prior to being coiled on a coiling mandrel 13 in which case the film is preferably supported by a carrier strip 14. If desired the carrier strip can also serve as a separating film and be coiled together with the magnetic film (not shown). a roller or pair of rollers that exert a controlled tension on the film and is advantageously so aligned as to yield a withdrawal angle of 15° to 45°. In place of the coiling device 13 a cutting and stapling apparatus can be substituted in order to stack the film in sheets.

The following examples illustrate the production and properties of magnetic film according to the invention.

EXAMPLE 1

Figure 2:
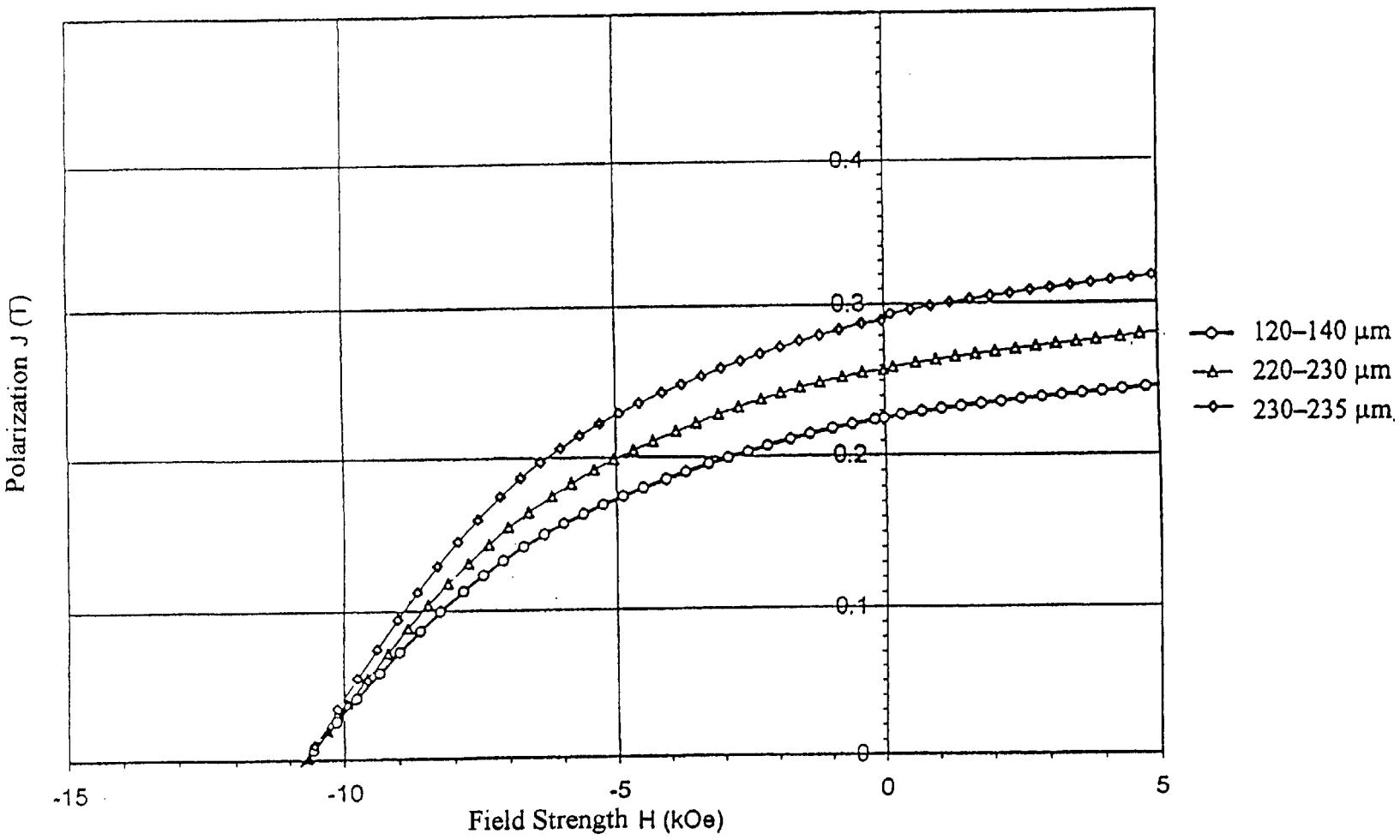
FIG. 2 are the degaussing (i.e. demagnetization) graphs of films made consistent with Example 1 of this application.

8.7 parts soluble polyvinylidene fluoride copolymer (SOLEF® 21508/1001, manufacturer: Solvay Kunststoffe), 1.4 parts surfactant (Disperbyk® 180, manufacturer: Byk Chemie) and 89.9 parts $Sm_2(Co,Cu,Fe,Zr)_{17}$ magnetic powder (VACOMAX® 240, manufacturer: Vacuumschmelze GmbH) were dissolved or dispersed in acetone. The magnetic powder was ground in a spray mill (i.e. jet mill) in the presence of nitrogen and passed through a 80 $\mu$m sieve to remove oversize particles. According to sieve analysis 60 mass % was finer than 25 $\mu$m and 1.8 mass % was coarser than 40 $\mu$m. Median particle size was determined at 10 $\mu$m. The complete solid fraction of the cast solution thus obtained was 78.3 mass %, the volume fraction of the magnetic powder after drying was approx. 63%. The casting apparatus described above was utilized to produce a film with a thickness of 120–140 $\mu$m. The film thus obtained had a density of 2.9–3.3 g/cm$^3$. In addition, varying the casting slit width and the magnetic powder content produced films with thicknesses of 220–230 $\mu$m and 230–235 $\mu$m, densities of 3.6–3.7 g/cm$^3$ and 4.0–4.1 g/cm$^3$ respectively. The films had a residual magnetism of 0.2–0.29 T at a coercive field strength of 10.6 kOe. The degaussing graphs of the films in this example are shown in FIG. 2.

EXAMPLE 2

Figure 3:
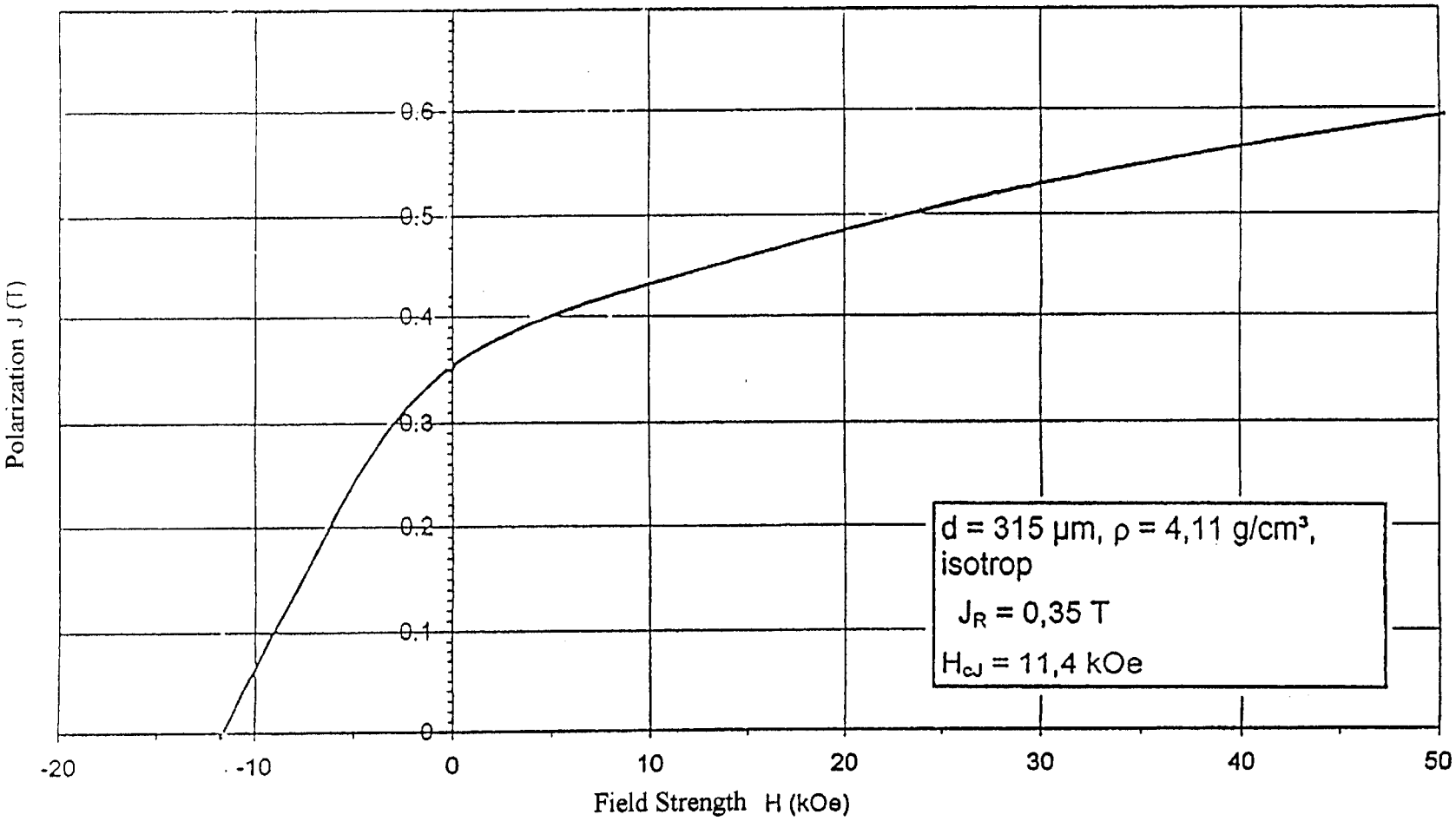
FIG. 3 is the degaussing graph of a film made consistent with Example 2 of this application.

The method as in Example 1 was followed except that a NdFeB magnetic powder was utilized in place of $Sm_2(Co,Cu,Fe,Zr)_{17}$ magnetic powder. The magnetic film thus obtained had a thickness of 315 $\mu$m, a density of 4.11 g/cm$^3$ and residual magnetism of 0.35 T at a coercive field strength of 11.4 kOe. The degaussing graph of this film is shown in FIG. 3.

EXAMPLE 3

Figure 4:
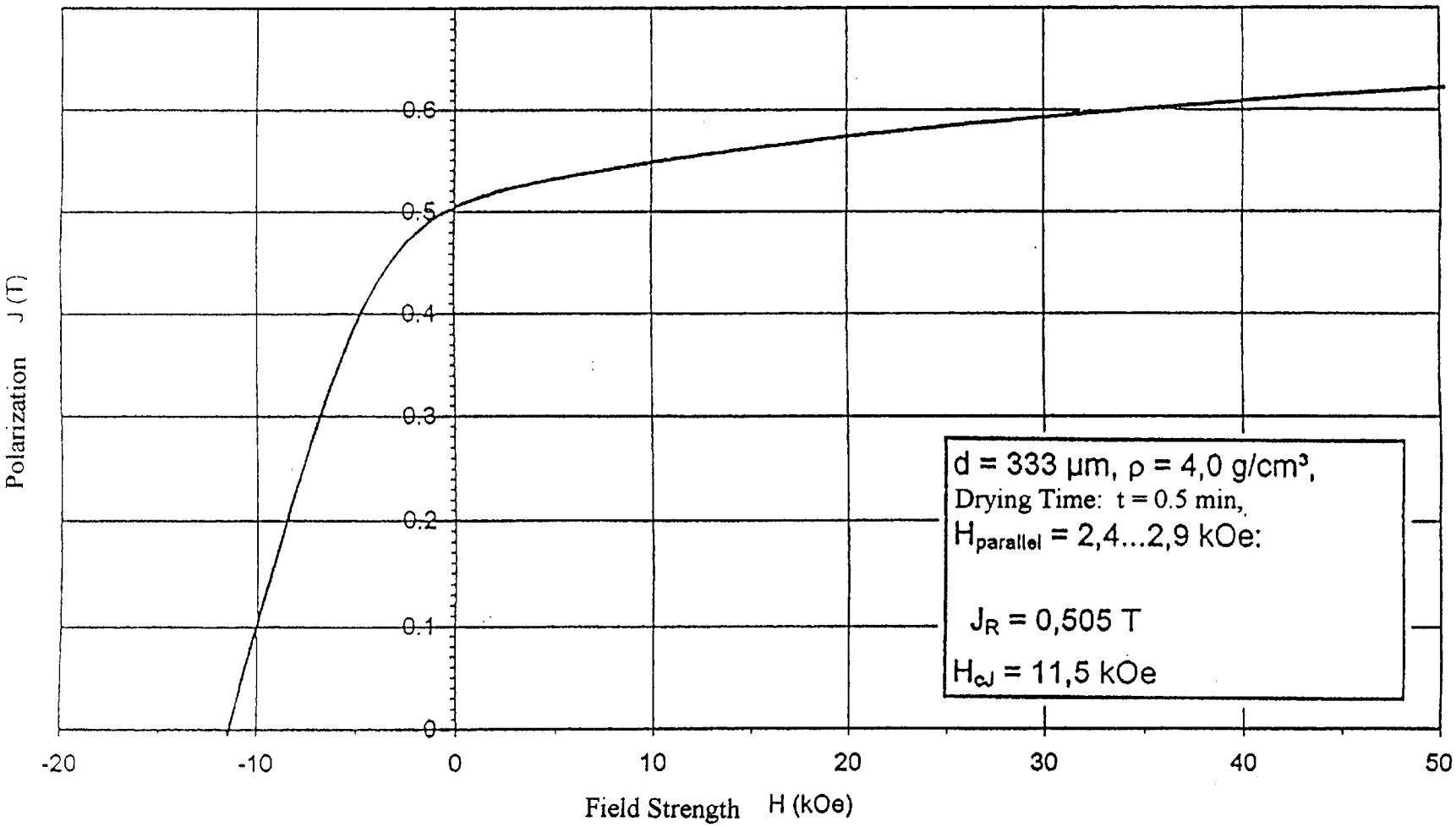
FIG. 4 is the degaussing graph of a film made consistent with Example 3 of this application.

The method as in Example 2 was followed except that an anisotropic NdFeB magnetic powder of type MAGNEQUENCH® MQP-T was utilized and after 0.5 min. drying time the film was subjected to a magnetic field of 2.4–2.9 kOe parallel to the surface so that the powder particles could align themselves in the not yet hardened film. The finished anisotropic film had a thickness of 333 $\mu$m, a density of 4.0 g/cm$^3$, a residual magnetism of 0.505 T parallel to the surface and a coercive field strength of 11.5 kOe. The degaussing graph of this film is shown in FIG. 4.

EXAMPLE 4

Figure 5:
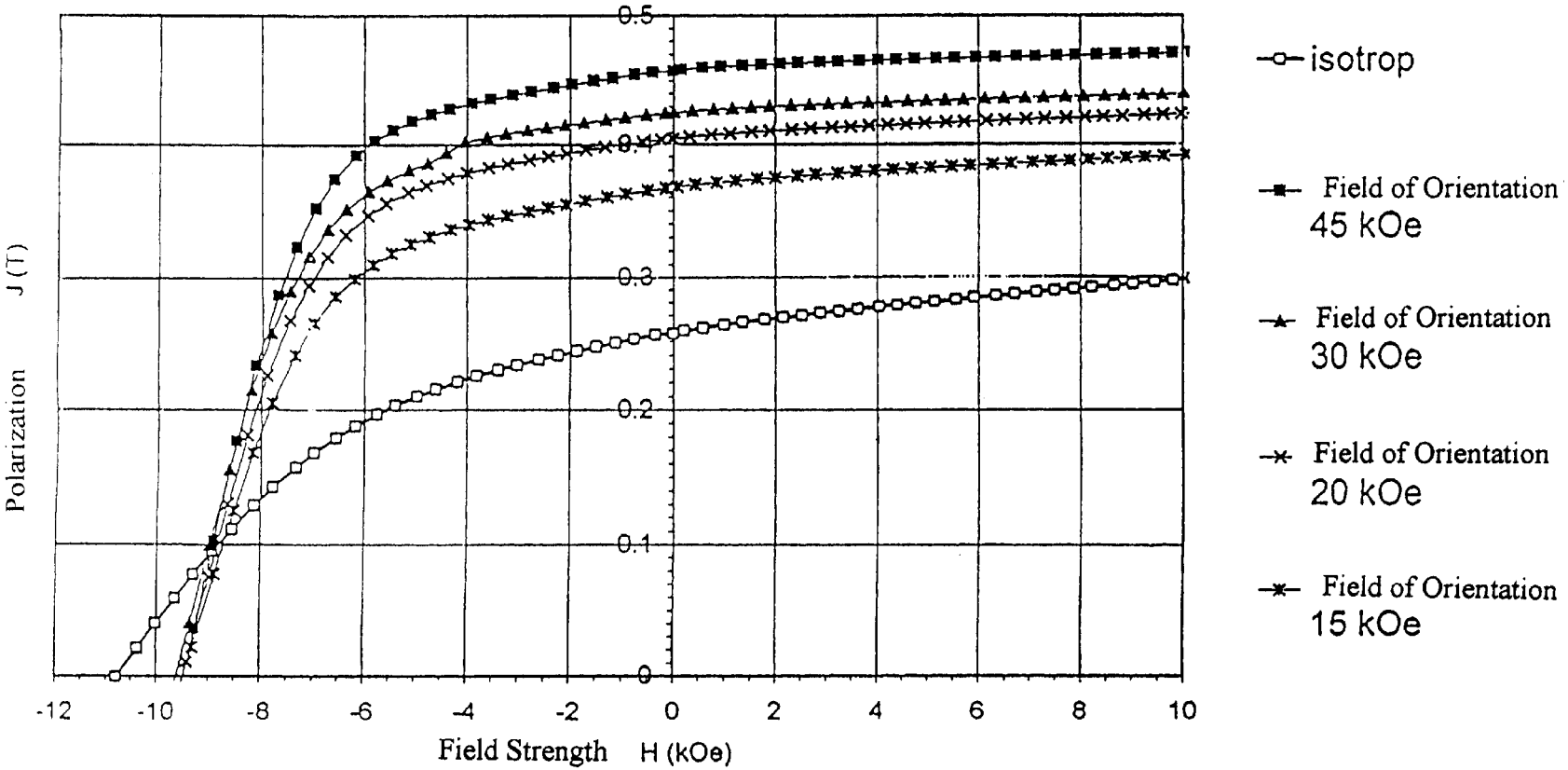
FIG. 5 are degaussing graphs of anisotropic magnetic films made consistent with Example 4 of this application together with the degaussing graph of a corresponding isotropic film.

A method similar to that of Example 1 was followed (magnetic powder: VACOMAX® 240), but, to align the anisotropic powder particles, after 0.5 min. drying time the film was subjected to pulsed external magnetic fields parallel to the surface. The field strengths were varied between 15 kOe (12 kA/cm) and 45 kOe (36 kA/cm). The degaussing graphs of the anisotropic magnetic films thus obtained are shown together with that of a corresponding isotropic film in FIG. 5. It is evident that the residual magnetism parallel to the surface increases from 0.26 T for the isotropic film up to 0.46 T after alignment at 45 kOe. The corresponding values after alignment at 15 kOe, 20 kOe and 30 kOe are 0.37 T, 0.41 T and 0.43 T respectively. Aligning the powder particles with magnetic field pulses parallel to the surface of the film improves the angle of orientation $f_D$ from 0.5 for the isotropic magnetic film up to 0.95. Owing to the improved orientation the coercive field strength is reduced from 11.5 kOe for the isotropic magnetic film to approximately 9 kOe for the anisotropic magnetic films.

What is claimed is:

1. Method for the production of hard magnetic film having a polymer matrix and a hard magnetic powder distributed therein with a median particle size finer than 100 $\mu$m, the method comprising:

(i) Producing a dispersion of hard magnetic powder with a median particle size finer than 100 $\mu$m in a solution or dispersion of polymer material in a volatile solvent, (ii) Casting the dispersion of hard magnetic powder as film of a defined thickness on a revolving casting belt, (iii) Evaporating the solvent, and (iv) Withdrawing the film thus formed from the casting belt.

2. Method as in claim 1 in which, between the casting process and withdrawing the film the hard magnetic powder particles are magnetized and aligned by means of an external magnetic field.

3. Method as in claim 2 further comprising hardening of the cast film after magnetizing and alignment have occurred.

4. Method as in claims 2 or 3 in which the external magnetic field is pulsed.

5. Method as in claims 2 or 3 in which the external magnetic field is created by means of a permanent magnet yoke.

6. Method as in claim 1 in which the hard magnetic powder contains a rare earth alloy.

7. Method as in claim 1 specially characterized in that it includes a rare earth alloy selected from the group consisting of: $RECo_5$, $(RE)_2(X)_{17}$ or $(RE)_2Fe_{14}B$ where (i) RE signifies one or more of the elements Y, La, Ce, Pr, Nd, Sm, Eu, Gd, Tb, Dy, Ho, Er, Tm, Yb or Lu and (ii) X represents one or more of Co, Fe, Cu, or Zr.

8. Method as in claim 1 in which the polymer material utilized is soluble polyvinylidene fluoride.

9. Method as in claim 8 in which the volatile solvent utilized is acetone.

* * * * *